US009706827B2

(12) United States Patent
Hietbrink et al.

(10) Patent No.: US 9,706,827 B2
(45) Date of Patent: Jul. 18, 2017

(54) EPILATOR WITH EXPOSED TWEEZER PORTION

(71) Applicant: KONINKLIJKE PHILIPS N.V., Eindhoven (NL)

(72) Inventors: Ingrid Hietbrink, Eindhoven (NL); Arthur Putzer, Eindhoven (NL); Martin Jakob Mitterer, Eindhoven (NL)

(73) Assignee: KONINLIJKE PHILIPS N.V., Eindhoven (NL)

( * ) Notice: Subject to any disclaimer, the term of this patent is extended or adjusted under 35 U.S.C. 154(b) by 132 days.

(21) Appl. No.: 14/428,410

(22) PCT Filed: Aug. 28, 2013

(86) PCT No.: PCT/IB2013/058046

§ 371 (c)(1),
(2) Date: Mar. 16, 2015

(87) PCT Pub. No.: WO2014/041453

PCT Pub. Date: Mar. 20, 2014

(65) Prior Publication Data

US 2015/0245696 A1 Sep. 3, 2015

Related U.S. Application Data

(60) Provisional application No. 61/701,757, filed on Sep. 17, 2012.

(51) Int. Cl.
*A45D 26/00* (2006.01)

(52) U.S. Cl.
CPC ..... *A45D 26/0042* (2013.01); *A45D 26/0028* (2013.01); *A45D 26/0066* (2013.01); *A45D 26/0076* (2013.01); *A45D 2026/0095* (2013.01)

(58) Field of Classification Search
CPC ..... A45D 26/0023; A45D 26/0028; A45D 26/0033; A45D 26/0066; A45D 26/0076
See application file for complete search history.

(56) References Cited

U.S. PATENT DOCUMENTS

| | | | |
|---|---|---|---|
| 3,949,469 | A | 4/1976 | Brauss |
| 4,807,624 | A | 2/1989 | Gross |
| 5,041,123 | A | 8/1991 | Oliveau |
| 5,112,341 | A | 5/1992 | Doley |
| 5,281,233 | A | 1/1994 | Dolev |

(Continued)

FOREIGN PATENT DOCUMENTS

| | | | |
|---|---|---|---|
| DE | 102008056328 | A1 | 5/2010 |
| EP | 0532106 | A1 | 3/1993 |

(Continued)

*Primary Examiner* — Julie A Szpira

(57) ABSTRACT

An epilating device removes hair from a user by pinching, pulling and releasing the hairs. The epilating device has a tweezer portion having an axis and being mounted to rotate about its axis during use, the tweezer portion defining at least one pinching region at its circumference in which hairs may be grasped by tweezer elements. The tweezer portion is mounted in cantilevered fashion by its first end to an attachment portion of a handle. The cantilever arrangement of the tweezer portion allows better access to the tweezer elements, in particular for epilating in areas that may otherwise be difficult to reach.

15 Claims, 6 Drawing Sheets

(56) References Cited

U.S. PATENT DOCUMENTS

| | | | | |
|---|---|---|---|---|
| 6,277,129 | B1 | 8/2001 | Poran | |
| 2005/0288687 | A1* | 12/2005 | Dorber | A45D 26/0028 606/133 |
| 2008/0209735 | A1* | 9/2008 | Haczek | A45D 26/00 30/43.91 |
| 2008/0313909 | A1 | 12/2008 | Haczek | |
| 2009/0076524 | A1 | 3/2009 | Julemont | |

FOREIGN PATENT DOCUMENTS

| | | | |
|---|---|---|---|
| EP | 2008543 | A1 | 12/2008 |
| WO | 2006117755 | A1 | 11/2006 |
| WO | 2008083531 | A1 | 7/2008 |

* cited by examiner

EPILATOR WITH EXPOSED TWEEZER PORTION

This application is the U.S. National Phase application under 35 U.S.C §371 of International Application No. PCT/IB2013/58046, filed on Aug. 28, 2013, which claims the benefit of U.S. Provisional Application No. 61/701,756, filed on Sep. 17, 2012, These applications are hereby incorporated by reference herein.

BACKGROUND OF THE INVENTION

Field of the Invention

The present invention relates to epilating devices and in particular to an epilator with an improved tweezer portion that can be easily accessed and which can be used on difficult to access regions of the body.

Description of the Related Art

Epilating devices of many different types are known for the purpose of removing unwanted hair from various regions of a user's body. The principles of operation vary greatly but amongst these devices, a sizeable subgroup operates through the use of rotating tweezer-mechanisms which seize hairs and actively extract them from the skin follicle. As the tweezer rotates further it releases the hair. In the present context, the term "tweezers" is used to denote an arrangement that is capable of opening and closing to grip and extract a hair or hairs.

One of the earliest devices of this type is the Epilady™ device, which uses the rotation of a coil spring to capture and release hairs. Another device is disclosed in EP532106B1. That device uses rotating disks which are pivotable towards each other under the influence of a compression member. The rotating disks form a disk package and are carried by an axle which rotates between bearings carried by bearing support members at either end of the disk package. The compression member comprises roller members located within the bearing support members. The drive mechanism for rotating the disk package is also located in this region of the device.

Although the known devices may operate adequately in most circumstances, for accessing narrow regions, the presence of the bearing support members can be inconvenient. They can restrict access to the tweezer mechanism and increase the overall width of the device. The construction also prevents access right around the tweezer mechanism, which in some situations may be desirable. The bearing support members also do not easily allow for interchanging of the tweezer mechanism, and certainly not for the use of a tweezer mechanism having a greater or lesser length. It would therefore be desirable to produce an epilating device that overcomes at least a number of these inconveniences.

BRIEF SUMMARY OF THE INVENTION

According to the invention there is provided an epilating device for removing hairs by pinching, pulling and releasing the hairs, the epilating device comprising: a housing having a handle portion and an attachment portion; and a tweezer portion having an axis, first and second ends, and at least one pair of tweezer elements for pinching the hairs, the tweezer elements being mounted to rotate about the axis during use; a drive element, arranged within the housing for engaging with the tweezer portion to apply rotational motion to rotate the tweezer elements about the axis, wherein the tweezer portion is mounted in cantilevered fashion by its first end to the attachment portion. In the present context, the term "cantilevered" may be considered to mean that the tweezer portion is attached to the handle portion solely by a connection of its first end to the attachment portion. The second end of the tweezer portion may thus be floating. The cantilever arrangement of the tweezer portion allows better access to the tweezer elements, in particular for epilating in areas that may otherwise be difficult to reach. A further advantage of this configuration is that access on all sides of the tweezer portion may be achieved i.e. around the full circumference. For many types of epilating device, the tweezer portion will define a pinching region at which pinching of the hairs occurs and it may only be necessary that the tweezer elements are exposed in this region. Nevertheless, other types of device may be capable of performing around their full circumference or may be adjustable to allow the pinching region to be re-positioned with respect to the handle portion. Access all around the tweezer portion is also convenient for cleaning thereof. In the present context, reference to the first and second ends of the tweezer portion is with respect to the axis. It is not intended to denote that the tweezer portion need be longer than its width. The first end may also be referred to as being a proximal end while the second end may be referred to as being the distal end.

According to a particularly advantageous embodiment of the invention, the tweezer portion is detachable from the housing. In the present context, detachable is intended to denote that the tweezer portion can be connected to and disconnected from the attachment portion by a user. This should be achievable by a simple connection mechanism, preferably without use of further tools. In a preferred embodiment, this may be achieved if the tweezer portion and the attachment portion are provided with interengaging bayonet type fittings. Nevertheless, the skilled person will be well aware that other forms of quick connect fittings may be equally applicable, to the extent that they can support the tweezer portion in a stable manner against the forces imposed upon it during use.

Preferably, the drive element comprises a drive wheel mounted within the attachment portion and the tweezer portion has a cog which engages with the drive wheel to transfer rotational motion to the tweezer elements. The epilating device may further comprise a motor and power supply, operatively arranged to engage and drive the drive element. The power supply may be a battery or a mains connection. The motor may be located within the handle portion and a transmission may be provided for engaging the drive element.

The principle of operation and construction according to the invention is applicable to all forms of tweezer portion that can be supported from one end in a cantilever fashion. In one particular preferred embodiment, the device comprises a proximal spring, mounted within the attachment portion for exerting a bias force on the tweezer portion to cause pinching of the tweezer elements. The bias force may preferably be exerted at a position distanced from the axis of the tweezer portion. This eccentric bias force can define the location of a pinching region as discussed above, at which pinching of the hairs takes place. The proximal spring may be a leaf spring, coil spring or an elastic material and may also form part of the attachment mechanism e.g. providing a bias force to a bayonet connection.

The tweezer portion preferably comprises a shaft on which the tweezer elements are mounted. In one embodiment the shaft is non-rotating and has an abutment surface adjacent to the second end of the tweezer portion. The tweezer elements may be arranged for rotation about the shaft between the abutment surface and the attachment portion. Another abutment surface may be provided adjacent the first end of the tweezer portion either by a surface of the attachment portion or by a non-rotating washer forming part of the tweezer portion.

The invention may also be applicable to devices in which the shaft is either straight or curved. In the case of a curved shaft, the pinching region will usually be defined by the concave direction of the shaft. In a preferred embodiment, the shaft is straight and the pinching region may be defined independently of the shaft, e.g. by the point of application of an eccentric bias force. Additionally or alternatively, the location of the pinching region may be defined by the position of the abutment surface. In such an embodiment, the abutment surface may be angled with respect to the shaft to define the pinching region, preferably at an angle of between 60 degrees and 88 degrees.

According to a further alternative embodiment, the device may comprise a distal spring, acting against an abutment surface at the second end of the tweezer portion to apply a force on the tweezer elements to cause pinching of the tweezer elements. The skilled person will thus understand that a bias on the tweezer elements can be achieved by a proximal spring at the first end of the tweezer portion or by a distal spring at the second end of the tweezer portion or by a combination of both.

In a still further preferred embodiment, the tweezer portion comprises a plurality of disks and the tweezer elements are formed by engaging surfaces of adjacent disks. The disks are preferably rigid, and may be formed of metal or ceramic material. Alternatively, a resilient disk structure may be considered. The disks may be individually rotatable with respect to each other or may be engaged together for rotation as a single body. The skilled person is well aware of the various disk structures that may be employed and the advantages and benefits associated therewith. The first and last disks of the tweezer portion may be integrally formed with a bearing plate. This may be in the form of a bearing race along which ball bearings may roll to provide a bearing function.

In a still further preferred embodiment of the invention, the tweezer portion comprises bearing elements on either side of the tweezer elements for facilitating rotation between the tweezer elements and non-rotating portions of the device. In one embodiment, the tweezer portion may be provided with ball bearings or the like supported by a bearing cage. The ball bearings may be supported by a cage to roll between the abutment surface or surface of the attachment portion and bearing plates on the tweezer portion.

According to one aspect of the invention and as discussed above, the tweezer portion may be uncovered, whereby the tweezer elements are exposed over the full circumference of the tweezer portion. An advantage of this configuration is that accessories may be placed over the tweezer portions from the second end towards the first end. Such accessories may be in the form of an accessory sleeve such as a guard or foil for covering or partially covering the tweezer elements e.g. around the pinching regions or sensitive caps to be applied in the bikini areas.

The invention also relates to an epilating device as generally described above in combination with one or more further accessories which can be selectively connected to the attachment portion after removal of the tweezer portion. One such accessory may comprise a further or alternate tweezer portion having a length that is different to that of the tweezer portion or otherwise differing in shape or function. Other accessories may include shaving, trimming or cutting accessories, a brush head and an exfoliation or peeling accessory.

Preferably the epilating device is waterproof or at least water resistant. Most preferably, the tweezer portion is waterproof, meaning that it can be washed, e.g. separately from the housing.

BRIEF DESCRIPTION OF THE DRAWINGS

The features and advantages of the invention will be appreciated upon reference to the following drawings of a number of exemplary embodiments, in which.

DESCRIPTION OF ILLUSTRATIVE EMBODIMENTS

Figure 1:
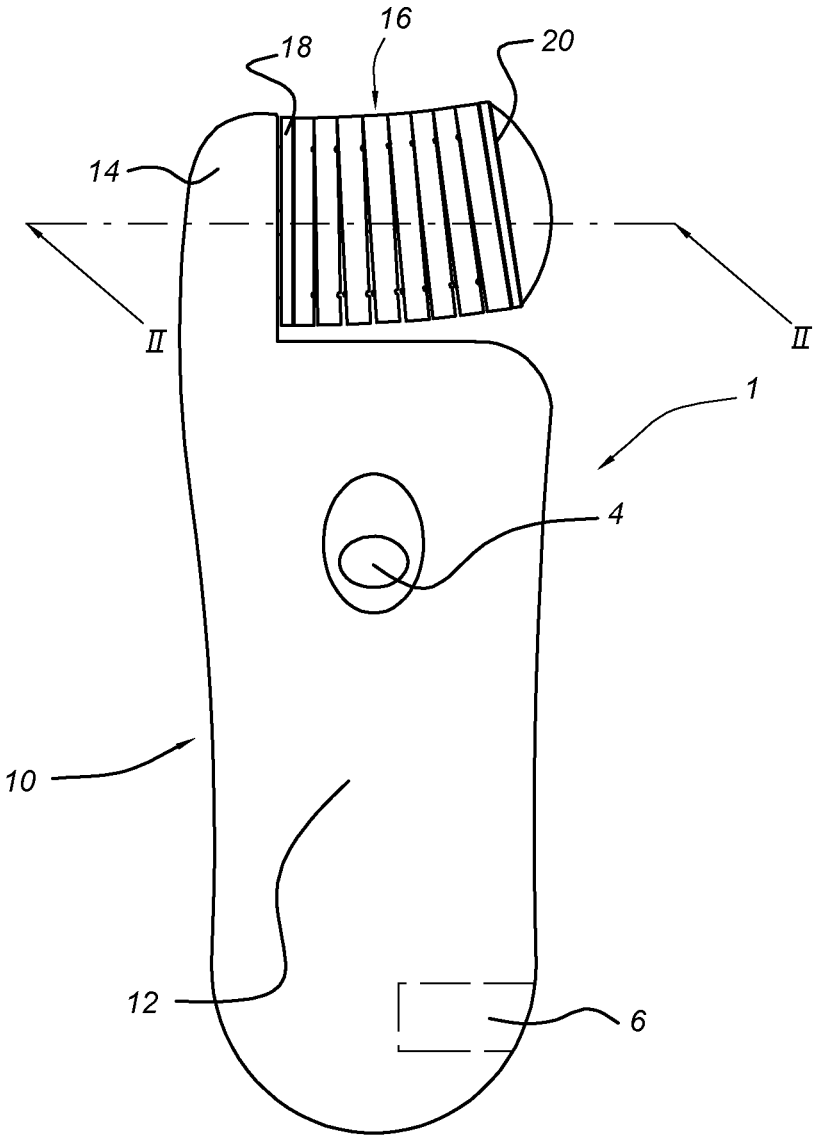
FIG. 1 shows a front view of an epilating device according to a first embodiment of the present invention.

FIG. 1 shows a front view of an epilating device 1 according to a first embodiment of the invention. The epilating device 1 comprises a housing 10 having a handle portion 12 and an attachment portion 14. A tweezer portion 16 having a first end 18 and a second end 20 is mounted to the attachment portion 14 by its first end 18. The epilating device 1 further has an actuator switch 4 and a connection 6 to an external power source.

Figure 2:
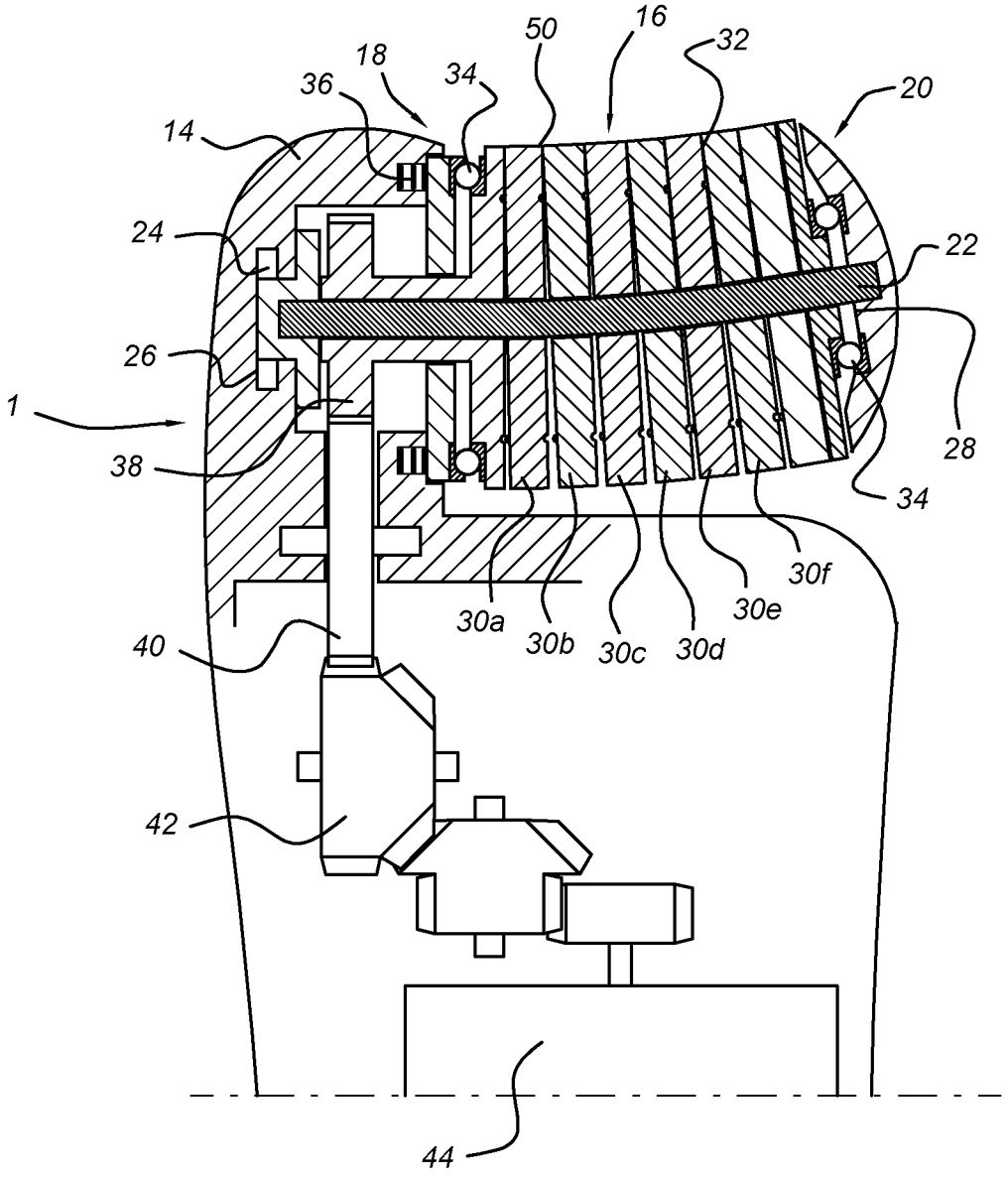
FIG. 2 shows a vertical cross-section through the epilating device of FIG. 1.

FIG. 2 shows a cross-sectional view through the epilating device 1 of FIG. 1 illustrating the construction of the tweezer portion 16 in further detail. As can be seen, tweezer portion 16 comprises a curved shaft 22 which carries a bayonet fitting 24 at the first end 18. At the second end 20 of the tweezer portion 16, the shaft 22 is provided with an abutment surface 28. The bayonet fitting 24 engages with a corresponding bayonet fitting 26 in the attachment portion 14. Mounted upon the shaft 22 is a plurality of disks 30A-F. The disks 30 can rotate with respect to the shaft 22 and form tweezer elements 32 at their outer circumference. The disks 30 engage against one another to rotate together and may be generally as described in WO2006117755A1, the contents of which are incorporated herein by reference in their entirety. At either end of the disk package 30A-F engaging with the first disk 30A and the last disk 30F respectively, there is provided a bearing element 34. The bearing element 34 at the second end of the tweezer portion 16 engages with the non-rotating abutment surface 28. At the first end of the tweezer portion 16 the bearing element 34 engages against a spring washer 36.

A cog 38 is connected to the first disk 30A. Cog 38 engages with a drive wheel 40 within the attachment portion 14. Drive wheel 40 is operatively connected via a transmission 42 to an electric motor 44.

Figure 3:
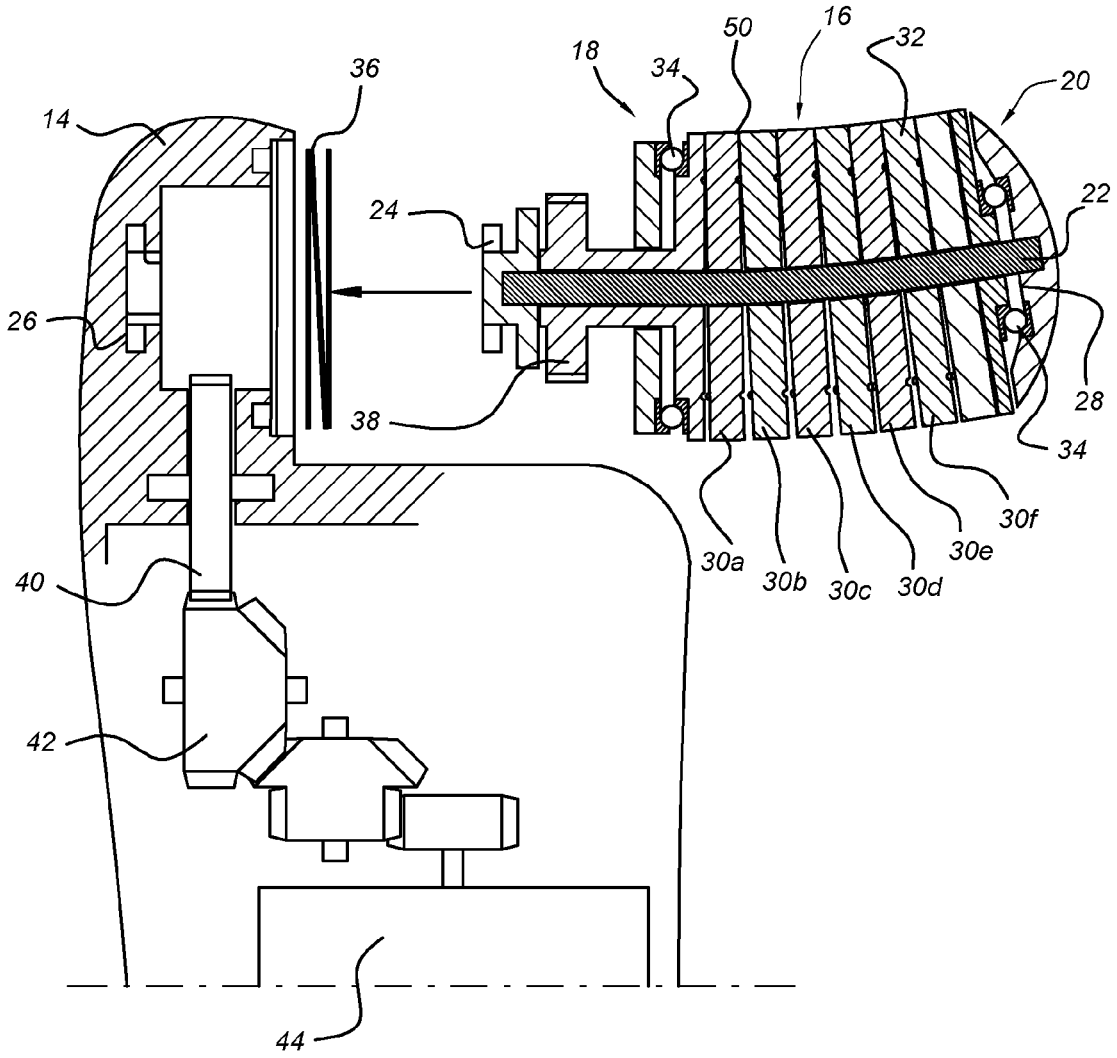
FIG. 3 shows a the device of FIG. 2 with the tweezer portion removed.

FIG. 3 shows a view of the epilating device 1, similar to FIG. 2, with the tweezer portion 16 removed. The bayonet fitting 24 on the shaft 22 and the corresponding bayonet fitting 26 in the attachment portion 14 can be more clearly seen, as can be the spring washer 36.

In use, the device of FIGS. 1 to 3 operates by rotation of the drive wheel 40 by motor 44 and transmission 42. The rotation is transmitted via the cog 38 to the first disk 30A which entrains the remaining disks 30B to 30F in rotation about shaft 22. Because the shaft 22 is curved and due to the bias force of the spring washer 36, the disks 30 are pressed against each other more tightly in a pinching region 50 located at the concave side of the curved shaft 22. In this pinching region 50, the tweezer elements 32 of adjacent disks 30 close together and pinch the hairs of skin being treated. As the disks 30 rotate further, the hairs are pulled and then subsequently released as the tweezer elements 32 open. In addition to providing a pinching force, the spring washer 36 also acts to maintain the bayonet fittings 24, 26 in mutual engagement.

Figure 4:
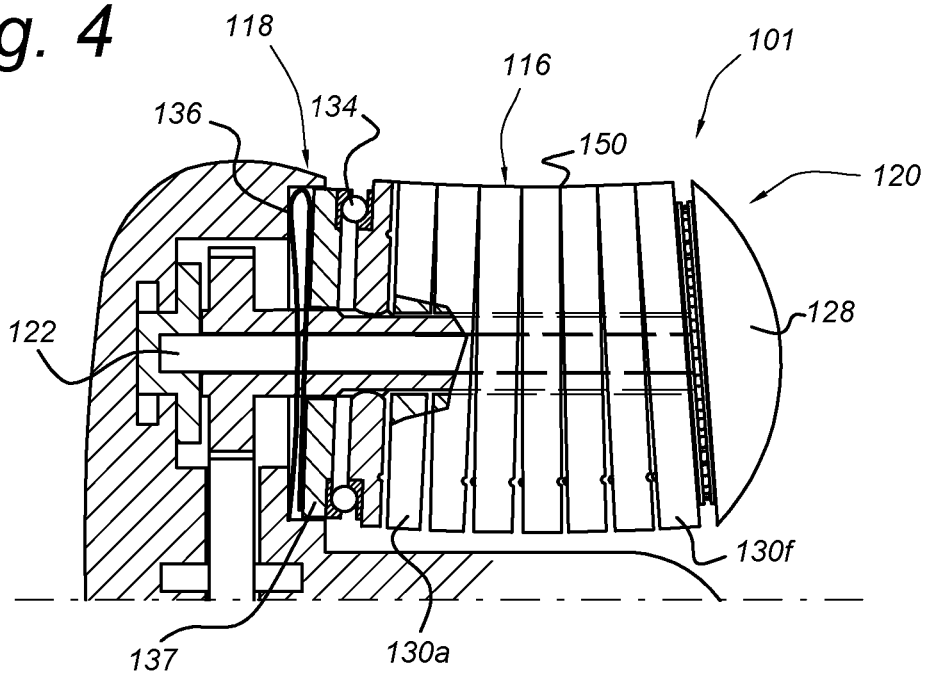
FIG. 4 shows a partial vertical cross-section through a second embodiment of the invention.

FIG. 4 shows an epilating device 101 according to a second embodiment of the invention in which like references preceded by 100 are used for elements corresponding to the first embodiment.

According to FIG. 4, the epilating device 101 has a tweezer portion 116 having a shaft 122 on which are mounted a plurality of disks 130A-130F. Unlike the first embodiment, shaft 122 is straight and carries an abutment surface 128 at the second end 120 which is angled at around 80 degrees with respect to the shaft 122. At its first end 118, the tweezer portion 116 is engaged by a proximal spring member 136. The proximal spring member 136 acts via a non-rotating washer 137 against bearing 134. The washer 137 is also angled by the proximal spring member 136 at an angle of around 80 degrees to the shaft 122. Operation of the device 101 according to FIG. 4 is essentially the same as that of the first embodiment. The angled disposition of the abutment surface 128 and the washer 137 force the disks 130 together in a pinching region 150. A primary advantage of this configuration is that an active pinching region 150 is formed almost to the second end 120 of the tweezer portion 116 allowing access within tight spaces. A straight axle configuration may be suitable for relatively short tweezer portions with a limited number of disks 130.

Figure 5:
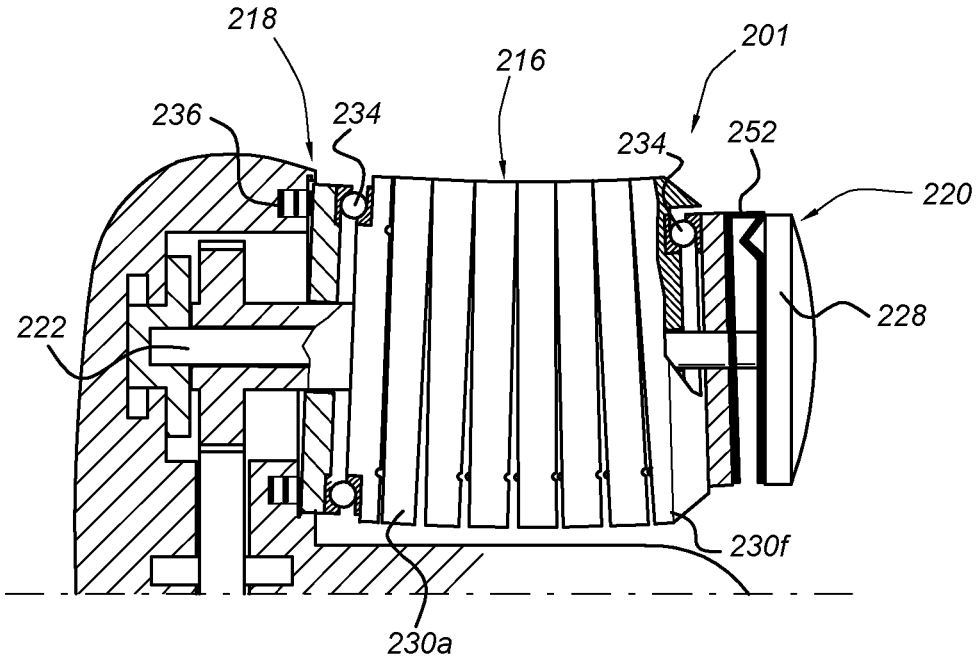
FIG. 5 shows a partial vertical cross-section through a third embodiment of the invention.

FIG. 5 shows an epilating device 201 according to a third embodiment of the invention in which like references preceded by 200 are used for elements corresponding to the first embodiment.

According to FIG. 5, the epilating device 201 has a tweezer portion 216 having a shaft 222 on which are mounted a plurality of disks 230A-230F. As in the second embodiment, shaft 222 is straight but unlike that embodiment, the abutment surface 228 at the second end 220 is perpendicular with respect to the shaft 222. A proximal spring washer 236 is provided at the first end 218 of the tweezer portion 216 and a distal spring washer 252 is provided at the second end 220 between the abutment surface 228 and a bearing 234. Operation of the device 201 according to FIG. 5 is essentially the same as that of the first and second embodiments. In this case however, the proximal and distal spring washers 236, 252 ensure a balanced force on the disks 230 of the tweezer portion 216 from both sides. Such a configuration may be desirable in the case of a longer tweezer portion 216 with a greater number of disks. A disadvantage is that the distal spring washer 252 occupies increased space at the second end 220 making access to tight spaces less convenient.

Figure 6:
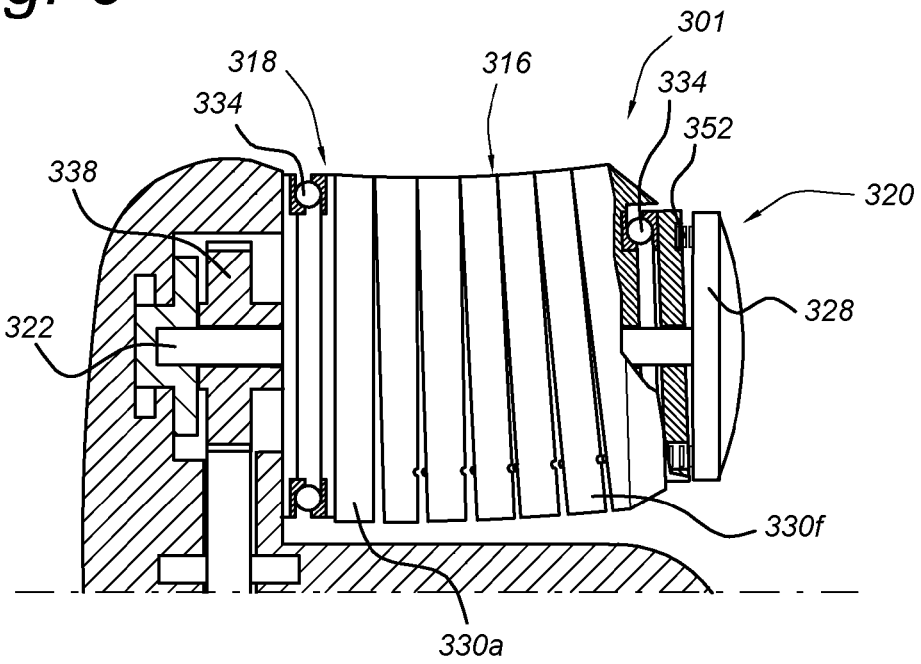
FIG. 6 shows a partial vertical cross-section through a fourth embodiment of the invention.

FIG. 6 shows an epilating device 301 according to a fourth embodiment of the invention in which like references preceded by 300 are used for elements corresponding to the first embodiment.

According to FIG. 6, the epilating device 301 has a tweezer portion 316 having a shaft 322 on which are mounted a plurality of disks 330A-330F. As in the second and third embodiments, shaft 322 is straight. Abutment surface 328 at the second end 320 is perpendicular with respect to the shaft 322. A distal spring washer 352 is provided between the abutment surface 328 and bearing 334. Unlike the third embodiment, no spring is provided at the first end 318 of the tweezer portion 316. The first disk 330A may therefore be perpendicular to the shaft 322 and need not be pivotable. Because the angle of the first disk 330A is fixed, it may be integrated with the cog 338.

Figure 7:
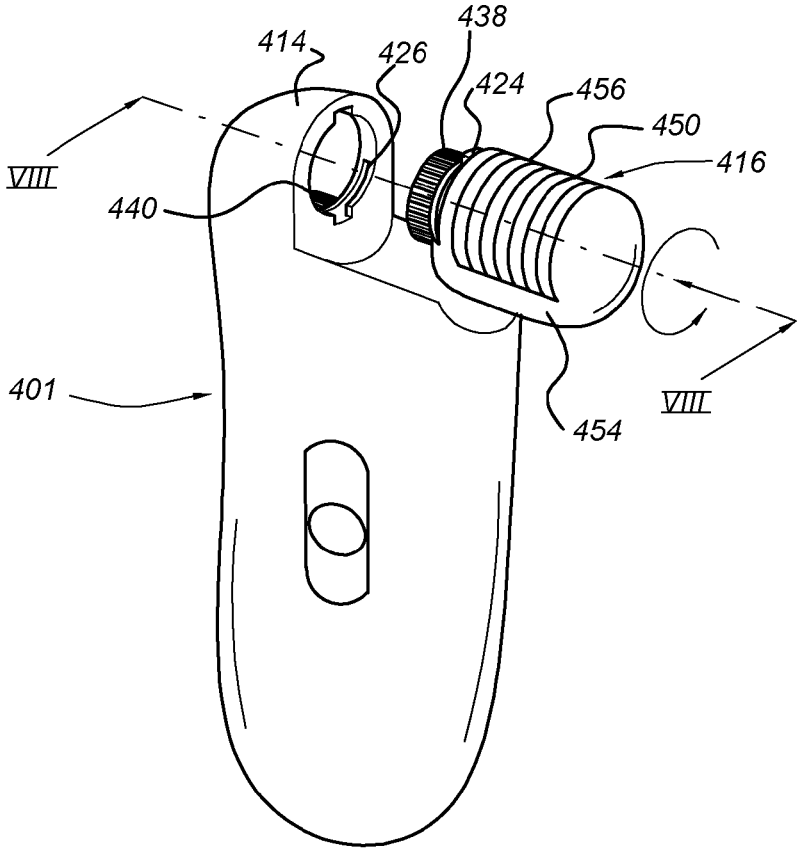
FIG. 7 shows a perspective view of an epilating device according to a fifth embodiment of the present invention.

An epilating device 401 according to a fifth embodiment of the invention is shown in perspective view in FIG. 7, in which like references preceded by 400 are used for elements corresponding to the first embodiment.

According to this embodiment the tweezer portion 416 comprises a tweezer housing 454 engageable with the attachment portion 414 by bayonet connections 424, 426 on the attachment portion 414 and on the tweezer housing 454. The tweezer housing 454 defines an opening 456 providing access to the pinching region 450. The cog 438 extends from the tweezer housing 454 to engage with the drive wheel 440 located within the attachment portion.

Figure 8:
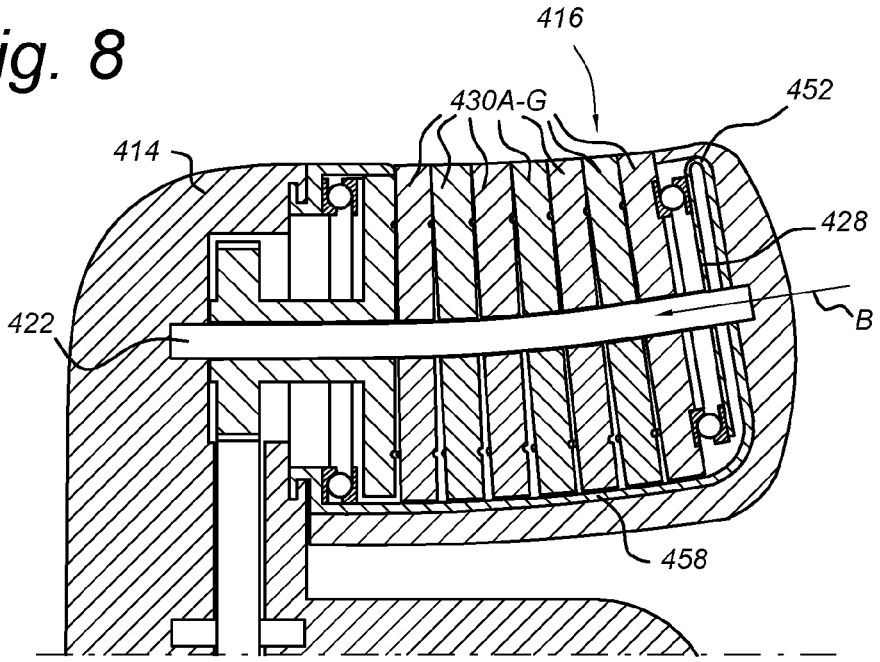
FIG. 8 shows a vertical cross-section through epilating device of FIG. 7.

FIG. 8 shows the epilating device 401 of FIG. 7 in partial cross-section. The device according to the fifth embodiment is substantially similar to the device of the fourth embodiment except that the shaft 422 no longer provides the connection between the attachment portion 414 and the abutment surface 428 at the second end of the tweezer portion 416. According to the fifth embodiment, the bias force that is to be applied against the disks 430 A-G of the tweezer portion 416 is transmitted to the abutment surface 428 through a spine portion 458 extending lengthwise within the tweezer housing 454 at a side opposite to that of the opening 456. Integrated with this spine portion 458 is a distal spring 452 which is also integrally formed with the abutment surface 428 and provides a bias force B to the disks 430. The spine portion 458, distal spring 452 and abutment surface 428 may be integrally formed from a single piece of spring material, e.g. by bending a plate-shaped piece of metal.

Figure 9:
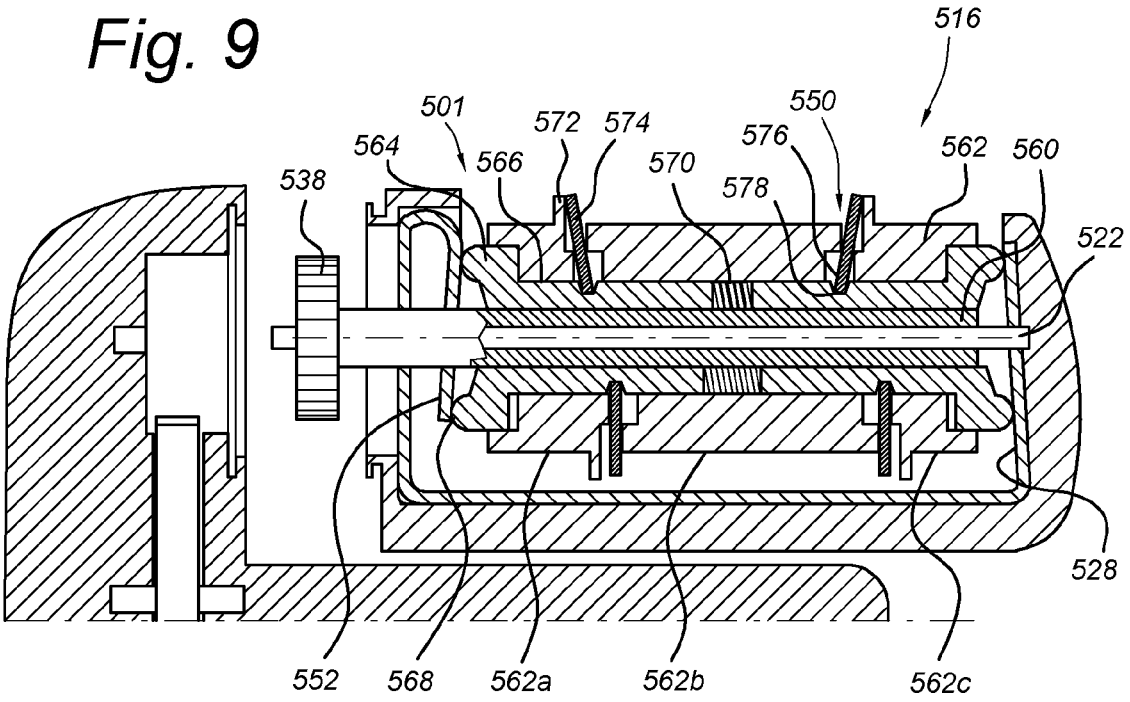
FIG. 9 shows a partial vertical cross-section through a sixth embodiment of the invention.

Although the above embodiments have been disclosed in relation to a disk based epilating system, the principles of the invention are equally applicable to alternative epilating elements. FIG. 9 shows a cross-sectional view through an epilating device 501 according to a sixth embodiment of the invention which operates with a rod-based tweezer system. In this embodiment, similar features to the first and second embodiments are denoted by the same reference numerals preceded by 500.

According to FIG. 9, a tweezer portion 516 comprises an inner body 560 and an outer body 562 arranged to rotate together about the shaft 522 under the action of a cog 538. Actuating rods 564 extend through channels 566 within the inner body 560 and have cam surfaces 568 at their outermost extremities. Return springs 570 within the channels 566 bias the rods 564 outwards such that the cam surfaces 568 engage with abutment surface 528 and proximal spring washer 552 respectively. The outer body 562 is formed in three sections 562 A, B, C. The skilled person will recognise that further sections may also be provided. Sections 562A and 562C comprise fixed tweezer elements 572 at their outer circumference. Pivotable tweezer elements 574 are held between adjacent sections 562 A,B,C and are engageable with the fixed tweezer elements 572. The pivotable tweezer elements 574 have inner ends 576 which engage with notches 578 formed in the rods 564.

The tweezer portion 516 according to the embodiment of FIG. 9 is generally as described in EP 2008543 A1, and may operate as described therein. The contents of that disclosure are hereby incorporated by reference in their entirety. Accordingly, during operation of the epilating device 501, the cog 538 causes rotation of the inner body 560 about the shaft 522. As the inner body 560 rotates, the cam surfaces 568 are biased inwards as they approach the pinching region 550. This bias causes inwards displacement of the actuating rods 564, which movement is transferred to the pivotable tweezer elements 574 by engagement of the inner ends 576 with notches 578. The pivotable tweezer elements 574 thus engage with the fixed tweezer elements 572 to pinch hairs and, as the tweezer portion 516 rotates further, to pull them out.

Thus, the invention has been described by reference to certain embodiments discussed above. It will be recognized that these embodiments are susceptible to various modifications and alternative forms well known to those of skill in the art. In particular, the construction of the tweezer portion may be distinct from the schematically illustrated design.

Many modifications in addition to those described above may be made to the structures and techniques described herein without departing from the spirit and scope of the invention. Accordingly, although specific embodiments have been described, these are examples only and are not limiting upon the scope of the invention.

The invention claimed is:

1. An epilating device for removing hairs from skin by pinching, pulling and releasing the hairs, comprising:

a housing having a handle portion and an attachment portion;

a tweezer portion having an axis, first and second ends and at least one pair of tweezer elements for pinching the hairs, the tweezer elements being mounted to rotate about the axis during use;

a drive element, arranged within the housing for engaging with the tweezer portion to apply rotational motion to rotate the tweezer elements about the axis;

wherein the tweezer portion is mounted in cantilevered fashion by its first end to the attachment portion, characterized in that the tweezer portion comprises a shaft which is non-rotating relative to the attachment portion, said shaft having an abutment surface adjacent the second end, and in that the tweezer elements are arranged for rotation about the shaft between the abutment surface and the attachment portion, further comprising at least one selected from the group consisting of (i) a proximal spring mounted within the attachment portion for exerting a bias force on the tweezer portion to cause pinching of the tweezer elements and (ii) a distal spring acting against the abutment surface for applying a bias force on the tweezer portion to cause pinching of the tweezer elements.

2. The device according to claim 1, wherein the tweezer portion can be connected to and disconnected from the attachment portion by a user.

3. The device according to claim 2, wherein the tweezer portion and the attachment portion are provided with interengaging bayonet type fittings.

4. The device according to claim 1, wherein the drive element comprises a drive wheel mounted within the attachment portion and the tweezer portion has a cog for engaging with the drive wheel.

5. The device according to claim 1, further comprising the proximal spring, mounted within the attachment portion for exerting a bias force on the tweezer portion to cause pinching of the tweezer elements.

6. The device according to claim 1, wherein the shaft is straight.

7. The device according to claim 6, wherein the abutment surface is angled with respect to the shaft at an angle of between 60 degrees and 88degrees.

8. The device according to claim 7, further comprising the distal spring, acting against the abutment surface to apply a force on the tweezer elements to cause pinching of the tweezer elements.

9. The device according to claim 1, wherein the tweezer portion comprises a plurality of disks and the tweezer elements are formed by engaging surfaces of adjacent disks.

10. The device according to claim 1, wherein the tweezer portion further comprises bearing elements on either side of the tweezer elements for facilitating rotation between the tweezer elements and non-rotating portions of the device.

11. The device according to claim 1, wherein the tweezer portion is uncovered, whereby the tweezer elements are exposed over the full circumference of the tweezer portion.

12. The device according to claim 1, further comprising an accessory sleeve that can be removably applied over the tweezer portion from the second end towards the first end.

13. The device according to claim 1, wherein the tweezer portion is waterproof.

14. A kit comprising an epilating device according to claim 1 and a further accessory which can be selectively connected to the attachment portion after removal of the tweezer portion.

15. The kit according to claim 14, wherein the accessory portion comprises an alternate tweezer portion having a length that is different to that of the tweezer portion.

* * * * *